US008602757B2

(12) United States Patent
Patterson

(10) Patent No.: US 8,602,757 B2
(45) Date of Patent: Dec. 10, 2013

(54) ROTARY DEVICE

(76) Inventor: Albert W. Patterson, West Lorne (CA)

( * ) Notice: Subject to any disclaimer, the term of this patent is extended or adjusted under 35 U.S.C. 154(b) by 812 days.

(21) Appl. No.: 12/823,672

(22) Filed: Jun. 25, 2010

(65) Prior Publication Data

US 2011/0171054 A1 Jul. 14, 2011

Related U.S. Application Data

(60) Provisional application No. 61/220,319, filed on Jun. 25, 2009.

(51) Int. Cl.
*F01C 19/00* (2006.01)
*F01C 1/00* (2006.01)

(52) U.S. Cl.
USPC ..... 418/144; 418/267; 418/268

(58) Field of Classification Search
USPC ..... 418/78, 104, 140, 144, 132, 133, 259, 418/260, 263, 266–269
See application file for complete search history.

(56) References Cited

U.S. PATENT DOCUMENTS

| | | | |
|---|---|---|---|
| 23,764 | A | 4/1859 | Freeman, Jr. |
| 68,186 | A | 8/1867 | Hall |
| 232,559 | A | 9/1880 | Smith |
| 390,044 | A | 9/1888 | Voorhies |
| 520,810 | A | 6/1894 | Thomson |
| 643,432 | A | 2/1900 | Washington et al. |
| 949,431 | A | 2/1910 | Hokanson |
| 1,014,495 | A | 1/1912 | Lincoln |
| 1,023,872 | A | 4/1912 | Pearson |
| 1,042,595 | A | 10/1912 | Pearson |
| 1,066,506 | A | 7/1913 | Krogel |
| 1,339,723 | A | 5/1920 | Smith |
| 1,349,353 | A | 8/1920 | Wilber, Jr. |
| 1,393,698 | A | 10/1921 | Piatt |
| 1,515,961 | A | 11/1924 | Meyer |
| 1,745,800 | A | 9/1930 | Kramer |
| 1,972,744 | A | 9/1934 | Lister |
| 2,098,244 | A | 11/1937 | Hopfensberger |
| 2,310,816 | A | 2/1943 | Taylor |
| 2,476,397 | A | 7/1949 | Bary |
| 2,536,938 | A | 1/1951 | Hunter |
| 2,728,300 | A | 12/1955 | Petersen |

(Continued)

FOREIGN PATENT DOCUMENTS

| | | |
|---|---|---|
| CA | 32552 | 10/1889 |
| CA | 115442 | 12/1908 |

(Continued)

*Primary Examiner* — Hoang Nguyen
(74) *Attorney, Agent, or Firm* — Head, Johnson & Kachigian, P.C.

(57) ABSTRACT

A device includes a ring having a tubular interior surface centred about an axis. The surface includes a plurality of axially extending, inwardly-projecting ridges. On opposite sides of each ridge is a first port and a second port. A rotor rotates in the ring about the axis. A plurality of vanes is mounted to the rotor body for rotation therewith and for radial extension and retraction relative thereto such that the surface can be swept by the vanes. The rotor and the ring are sealed to permit fluid communication into and out of the device only via the ports. The vanes retract and extend as the body rotates such that chambers are created which decrease in volume when in communication with the first ports and chambers are created which increase in volume when in communication with the second ports. A fluid pressure mechanism can cause vane retraction.

15 Claims, 14 Drawing Sheets

(56) References Cited

U.S. PATENT DOCUMENTS

| | | | | |
|---|---|---|---|---|
| 2,819,677 | A | 1/1958 | Leath | |
| 2,853,978 | A | 9/1958 | Smyser | |
| 3,057,157 | A | 10/1962 | Close | |
| 3,057,304 | A | 10/1962 | Rohde | |
| 3,305,209 | A | 2/1967 | Bender et al. | |
| 3,312,387 | A | 4/1967 | Cassidy et al. | |
| 3,401,641 | A * | 9/1968 | Adams et al. | 418/268 |
| 3,431,861 | A | 3/1969 | Martin | |
| 3,464,395 | A | 9/1969 | Kelly | |
| 3,478,728 | A | 11/1969 | Kelly | |
| 3,514,237 | A | 5/1970 | Spyridakis | |
| 3,525,963 | A | 8/1970 | Burdett | |
| 3,640,648 | A | 2/1972 | Odawara | |
| 3,694,114 | A | 9/1972 | Eickmann | |
| 3,727,589 | A | 4/1973 | Scott | |
| 3,797,975 | A | 3/1974 | Keller | |
| 3,863,611 | A | 2/1975 | Bakos | |
| 3,873,253 | A | 3/1975 | Eickmann | |
| 4,086,645 | A | 4/1978 | Gorman et al. | |
| 4,154,208 | A | 5/1979 | Kunieda et al. | |
| 4,203,062 | A | 5/1980 | Bathen | |
| 4,408,964 | A | 10/1983 | Mochizuki et al. | |
| 4,410,305 | A | 10/1983 | Shank et al. | |
| 4,415,322 | A | 11/1983 | Baudin | |
| 4,416,598 | A | 11/1983 | Merz | |
| 4,418,663 | A | 12/1983 | Bentley | |
| 4,432,711 | A | 2/1984 | Tsuchiya et al. | |
| 4,468,964 | A | 9/1984 | Groeneweg | |
| 4,484,863 | A | 11/1984 | Pagel | |
| 4,551,896 | A | 11/1985 | Sakamaki et al. | |
| 4,561,834 | A | 12/1985 | Poss | |
| 4,646,568 | A | 3/1987 | Lew | |
| 4,772,187 | A | 9/1988 | Thompson | |
| 4,917,584 | A | 4/1990 | Sakamaki et al. | |
| 4,958,995 | A | 9/1990 | Sakamaki et al. | |
| 5,002,473 | A | 3/1991 | Sakamaki et al. | |
| 5,092,752 | A | 3/1992 | Hansen | |
| 5,160,252 | A * | 11/1992 | Edwards | 418/1 |
| 5,163,825 | A | 11/1992 | Oetting | |
| 6,030,195 | A * | 2/2000 | Pingston | 418/82 |
| 6,439,868 | B1 | 8/2002 | Tomoiu | |
| 6,527,525 | B2 * | 3/2003 | Kasmer | 418/31 |
| 6,554,596 | B1 | 4/2003 | Patterson et al. | |
| 6,776,136 | B1 | 8/2004 | Kazempour | |
| 6,799,549 | B1 | 10/2004 | Patterson et al. | |
| 6,896,502 | B1 | 5/2005 | Patterson | |
| 6,899,528 | B2 | 5/2005 | Youngpeter et al. | |
| 6,945,218 | B2 * | 9/2005 | Patterson | 123/264 |
| 7,048,526 | B2 | 5/2006 | Patterson | |
| 7,229,262 | B2 * | 6/2007 | Patterson | 418/133 |
| 8,011,909 | B2 * | 9/2011 | Dong | 418/136 |
| 2005/0196299 | A1 | 9/2005 | Patterson | |

FOREIGN PATENT DOCUMENTS

| | | |
|---|---|---|
| CA | 202671 | 8/1920 |
| CA | 203163 | 8/1920 |
| DE | 2628539 | 1/1977 |
| DE | 29720052 | 2/1998 |
| GB | 166871 | 1/1922 |
| GB | 468390 | 7/1937 |
| GB | 2078303 | 1/1982 |
| GB | 2401402 | 11/2004 |
| JP | 57032095 | 2/1982 |
| JP | 61152987 | 7/1986 |
| JP | 61241482 | 10/1986 |
| JP | 3206381 | 9/1991 |
| JP | 6307252 | 11/1994 |

* cited by examiner

ROTARY DEVICE

CROSS-REFERENCE TO RELATED APPLICATIONS

This application claims priority to U.S. Provisional Application No. 61/220,319 filed Jun. 25, 2009, which is herein incorporated by reference.

FIELD OF THE INVENTION

The present invention relates to the field of rotary devices, such as pumps and motors.

BACKGROUND OF THE INVENTION

Vane pumps are well-known positive-displacement pumps. A simple vane pump consists of a rotor positioned inside a larger circular cavity. The rotation axis is offset from the axis of the cavity and vanes are allowed to slide into and out of the rotor and seal on all edges. This creates, on one side of the pump, vane chambers that increase in volume. These increasing volume vane chambers are filled with fluid forced in by the inlet pressure. Often this inlet pressure is nothing more than pressure from the atmosphere. On the discharge side of the pump, there are created vane chambers which decrease in volume. This forces fluid out of the pump. Typically, these pumps run at relatively high speeds, and the centrifugal force associated with the rotation is used to hold the vanes against the surface of the interior cavity for sealing. While vane pumps are known to have utility, many suffer from a disadvantageous combination of relatively high cost and relatively low longevity.

SUMMARY OF THE INVENTION

A rotary device forms one aspect of the invention and comprises a barrier ring, a rotor, a plurality of vanes, a sealing structure and an arrangement. The barrier ring has a central longitudinal axis and a tubular interior surface through which the longitudinal axis extends centrally, in spaced relation. The interior surface includes one or more portions which each define a longitudinally extending, inwardly-projecting ridge. Defined through the interior surface, on opposite circumferential sides of each of said one or more ridges, is a first port and a second port. The rotor is mounted for rotation in the barrier ring about the longitudinal axis and includes a rotor body. The vanes are mounted to the rotor body for rotation with the rotor body about the longitudinal axis and for radial extension and retraction relative to the rotor body such that at least portions of the interior surface of the barrier ring can be swept by the vanes. The sealing structure provides a seal between the rotor and the barrier ring to permit fluid communication into and out of the rotary device substantially only via the first and second ports. The arrangement, which is for causing the vanes to retract and extend as the rotor body rotates such that chambers are created which decrease in volume when in communication with the first ports and such that chambers are created which increase in volume when in communication with the second ports, includes a fluid pressure mechanism for causing the vanes to retract.

According to another aspect of the invention, the rotor can further comprise a pair of axially spaced supports which support the axially-spaced edges of the vanes when extended from the rotor body.

According to another aspect of the invention, the fluid pressure mechanism can be for causing retraction and, at least in part, extension of the vanes.

According to another aspect of the invention, the rotor can define a slot for each vane, and each vane can be mounted in the slot provided for it in the manner of a piston in a cylinder. As well, the fluid pressure mechanism can comprise a fluid circuit which couples the base of each slot to a point in the rotor which, in rotation, immediately precedes the slot immediately preceding the slot from which said fluid path extends.

According to another aspect of the invention, the rotor can define a slot for each vane, each vane being mounted in the slot provided for it in the manner of a piston in a cylinder, and the fluid pressure mechanism can comprise a fluid circuit which, in rotation, selectively couples the base of each slot approaching a ridge to the base of the slot immediately preceding said each slot.

According to another aspect of the invention: the rotor can define a slot for each vane, each vane being mounted in the slot provided for it in the manner of a piston in a cylinder; the fluid pressure mechanism can provide for fluid communication between slots occupied by vanes which need to retract to breach the ridges and slots occupied by vanes which need to extend to sweep the barrier ring; and in use, the pressure of the fluid passing between the first and second ports can provide the motive force for the extension and retraction of the vanes.

According to another aspect of the invention, the fluid pressure mechanism can cause the vanes to retract as they approach the ridges and to extend after they pass the ridges.

According to another aspect of the invention, in each slot, a spring can bias the vane mounted within said each slot for extension.

According to another aspect of the invention, the spring compression can vary over its length, such that, in use, relatively high force is required to bottom out the spring and such that, as the vane reaches full extension, the spring provides relatively low force to the vane.

According to another aspect of the invention, the one or more portions can comprise a plurality of portions, each defining a longitudinally extending, inwardly-projecting ridge.

According to another aspect of the invention, the first ports can be outlets and the second ports can be inlets.

The rotary device can, according to another aspect of the invention, form part of a pump for a fluid. In this pump, a shaft is coupled to the rotor body for receiving power and converting received power into rotation of the rotor such that, if the inlets are placed in communication with a supply of said fluid at a relatively low pressure, the outlets create a supply of fluid at a relatively higher pressure.

In this pump, the vanes can have neutral buoyancy in said fluid.

The pump itself can, according to another aspect of the invention, form part of a fluid pumping system. This system includes a windmill which, in use, can rotate at less than 20 rpm and which can drive the pump at less than 20 rpm.

The invention permits the construction of pumps that operate at relatively low rotational speed, that are relatively robust, that have relatively high flow capacity and that are of relatively high-efficiency.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

DETAILED DESCRIPTION OF THE PREFERRED EMBODIMENTS

Figure 1:
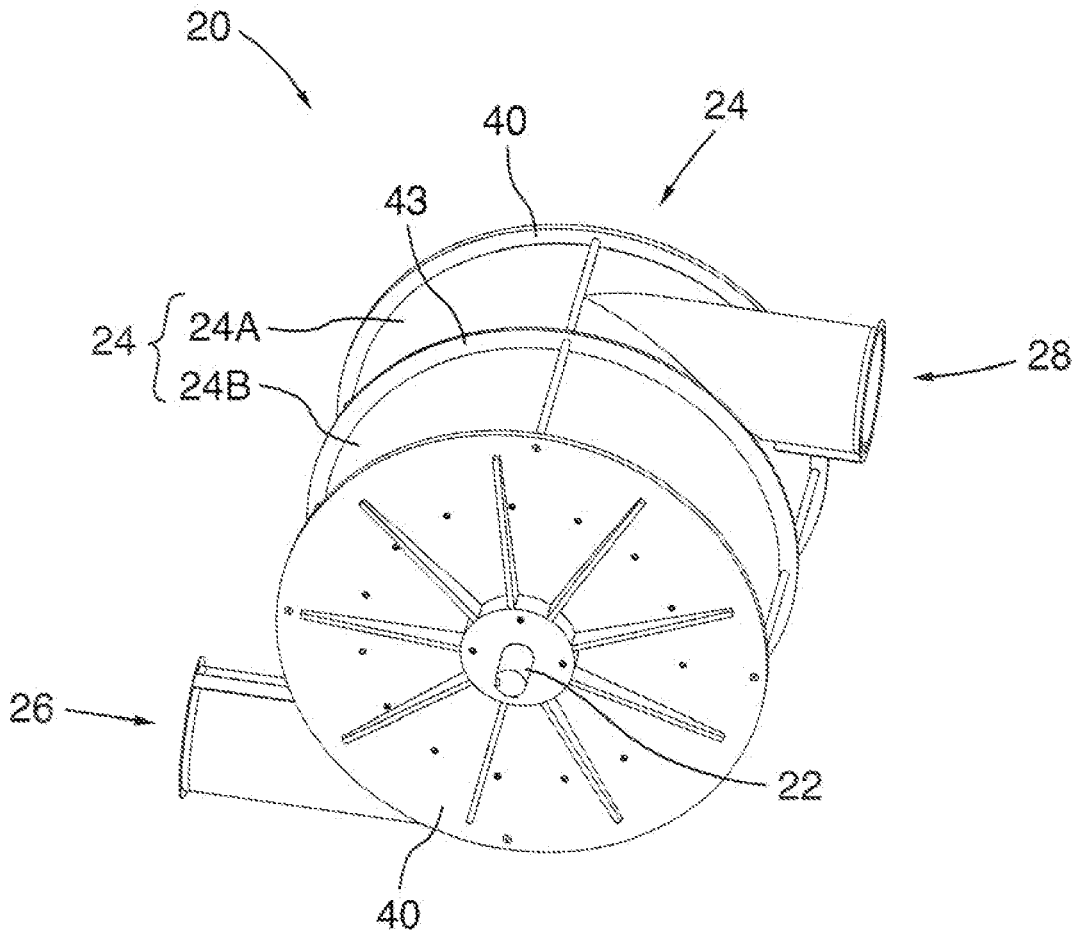
FIG. 1 is a perspective view of a rotary device according to an exemplary embodiment of the present invention and having a housing.

A rotary device 20 according to an exemplary embodiment of the invention is shown in perspective view in FIG. 1 and will be seen to include a shaft 22 and a housing 24, the housing 24 being defined by two parts 24A,24B and having defined therein a fluid inlet port 26 and a fluid outlet port 28.

Figure 2:
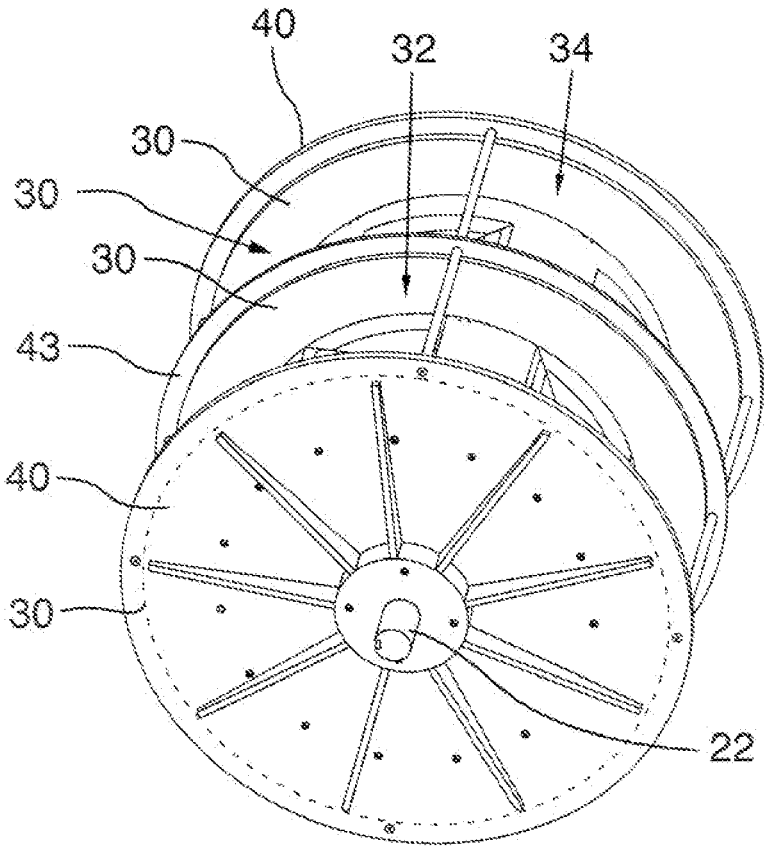
FIG. 2 is a view of the structure of FIG. 1, with a portion of the housing removed for clarity.

FIG. 2 shows the structure of FIG. 1, with the housing removed, to reveal manifold supporting bosses 30 which longitudinally bound and partially define a pair of manifold channels 32,34, to which the fluid inlet port 26 and fluid outlet port 28 (neither shown) lead.

Figure 3:
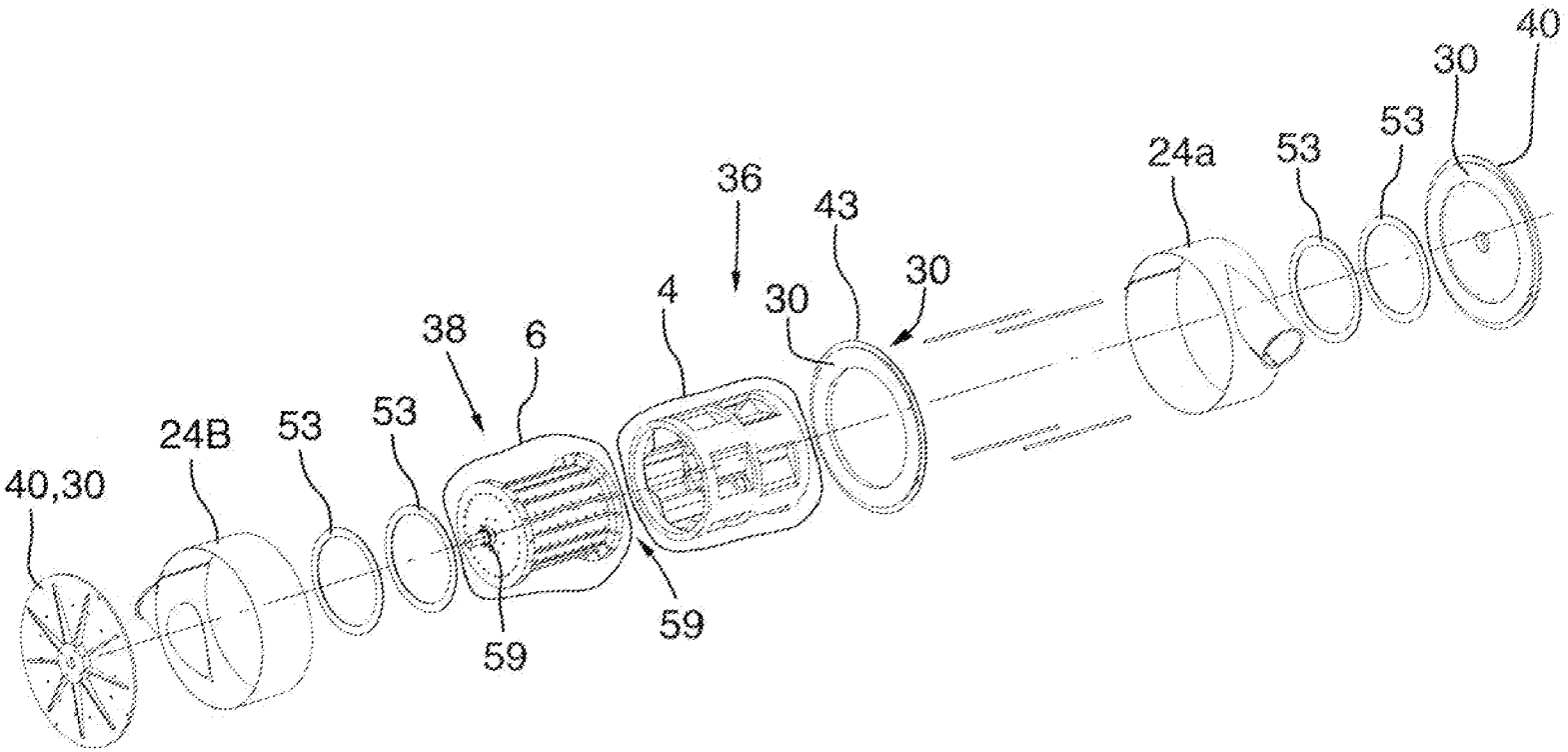
FIG. 3 is an exploded view of the rotary device of FIG. 1.

FIG. 3 is an exploded view of the structure of FIG. 1. The components of the rotary device will be seen to additionally include a barrier ring 36, a rotor assembly 38, a pair of end caps 40, a separator ring 43, gaskets 53 and bearings 59.

The supporting bosses 30 form part of the end caps 40 and the separator ring 43.

Figure 4:
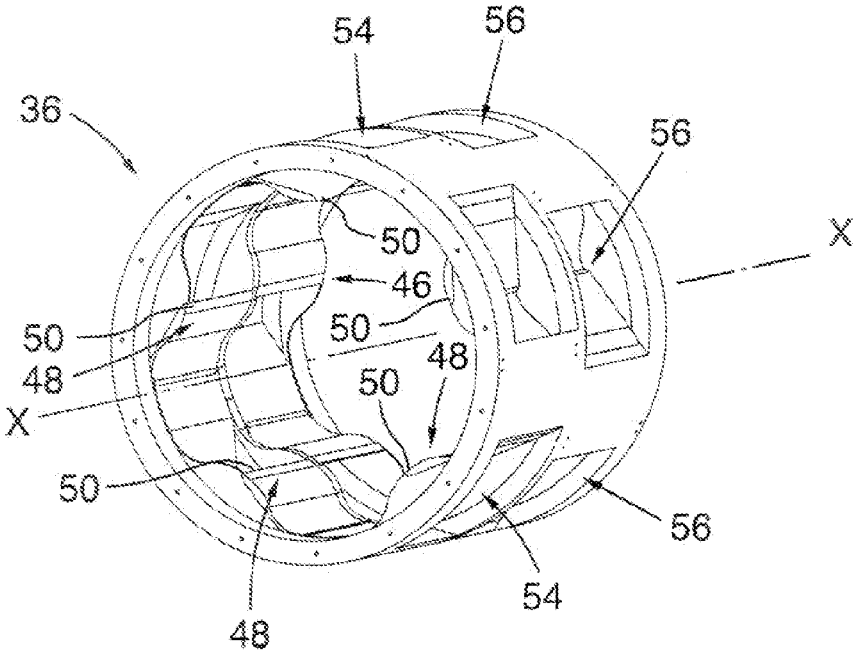
FIG. 4 is a view of encircled area 4 of FIG. 3.
Figure 5:
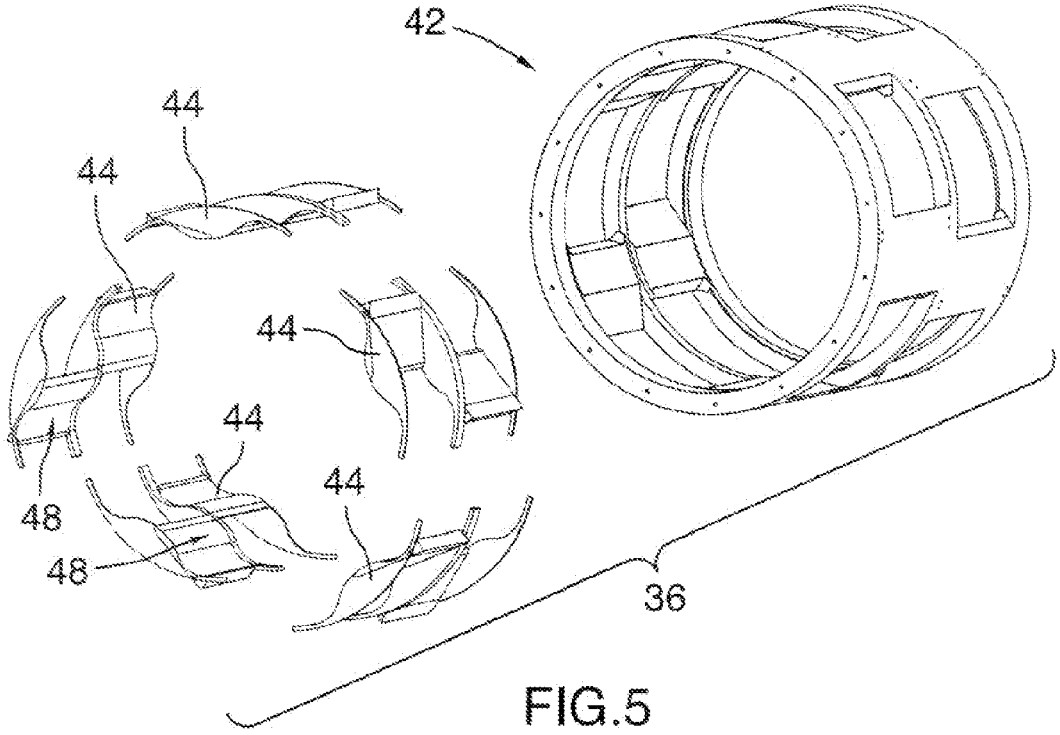
FIG. 5 is a partially exploded view of the structure of FIG. 4.

The barrier ring 36 is circumferentially supported by the supporting bosses 30 inside the housing 24 and, as best seen in FIG. 4 and FIG. 5, wherein the ring 36 is shown in isolation in perspective and exploded perspective, is formed of a support ring 42 and five bridging elements 44.

The barrier ring 36 has a central longitudinal axis X-X and a tubular, undulating interior surface 46 through which the longitudinal axis X-X extends centrally, in spaced relation. The interior surface 46 includes a plurality of, specifically five, portions 48, each defining a longitudinally extending, inwardly-projecting ridge 50.

On opposite circumferential sides of each of said one or more ridges 50 is defined an inlet 54 in the form of a second port and an outlet 56 in the form of a first port, the inlets 54 collectively communicating with the inlet manifold 32 and the outlets 56 collectively communicating with the outlet manifold 34.

The separator ring 43 separates the housing parts 24A,24B from one another, and avoids comingling of the flows leading into and out of the rotary device.

Figure 6:
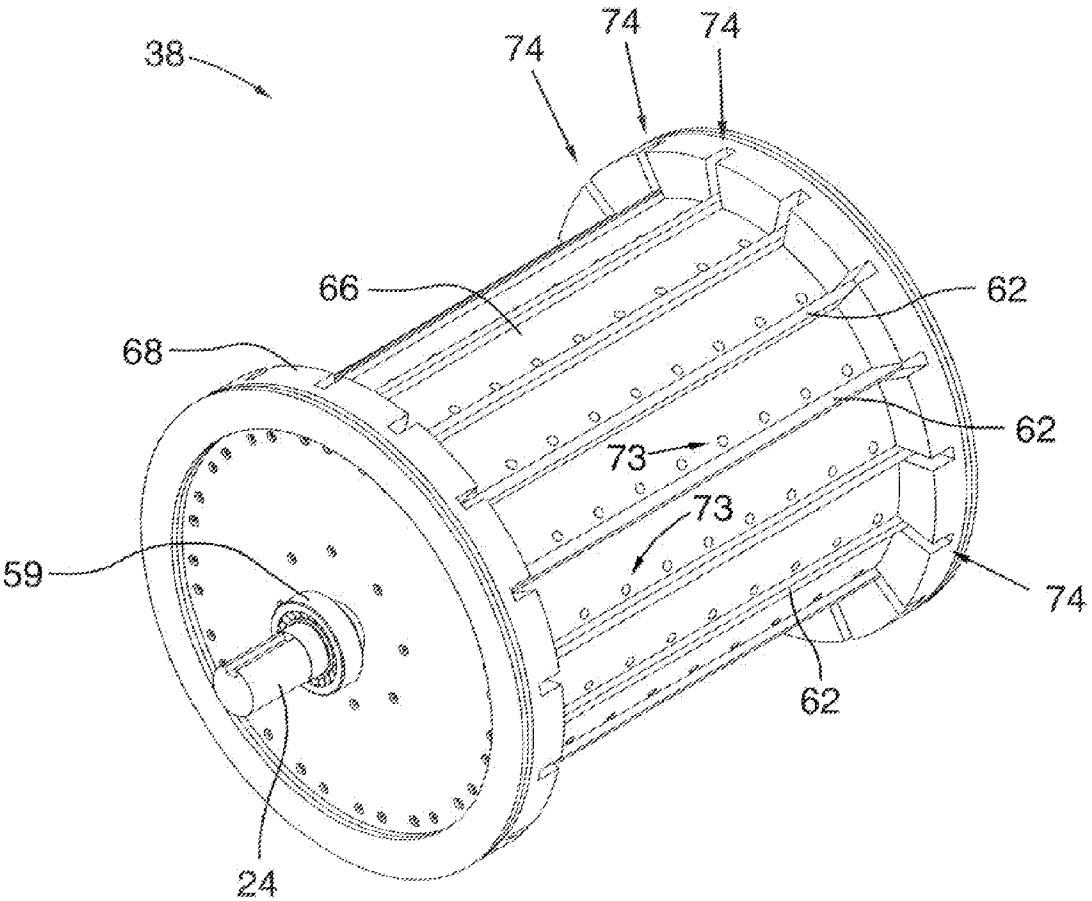
FIG. 6 is a view of encircled area 6 of FIG. 3.
Figure 6A:
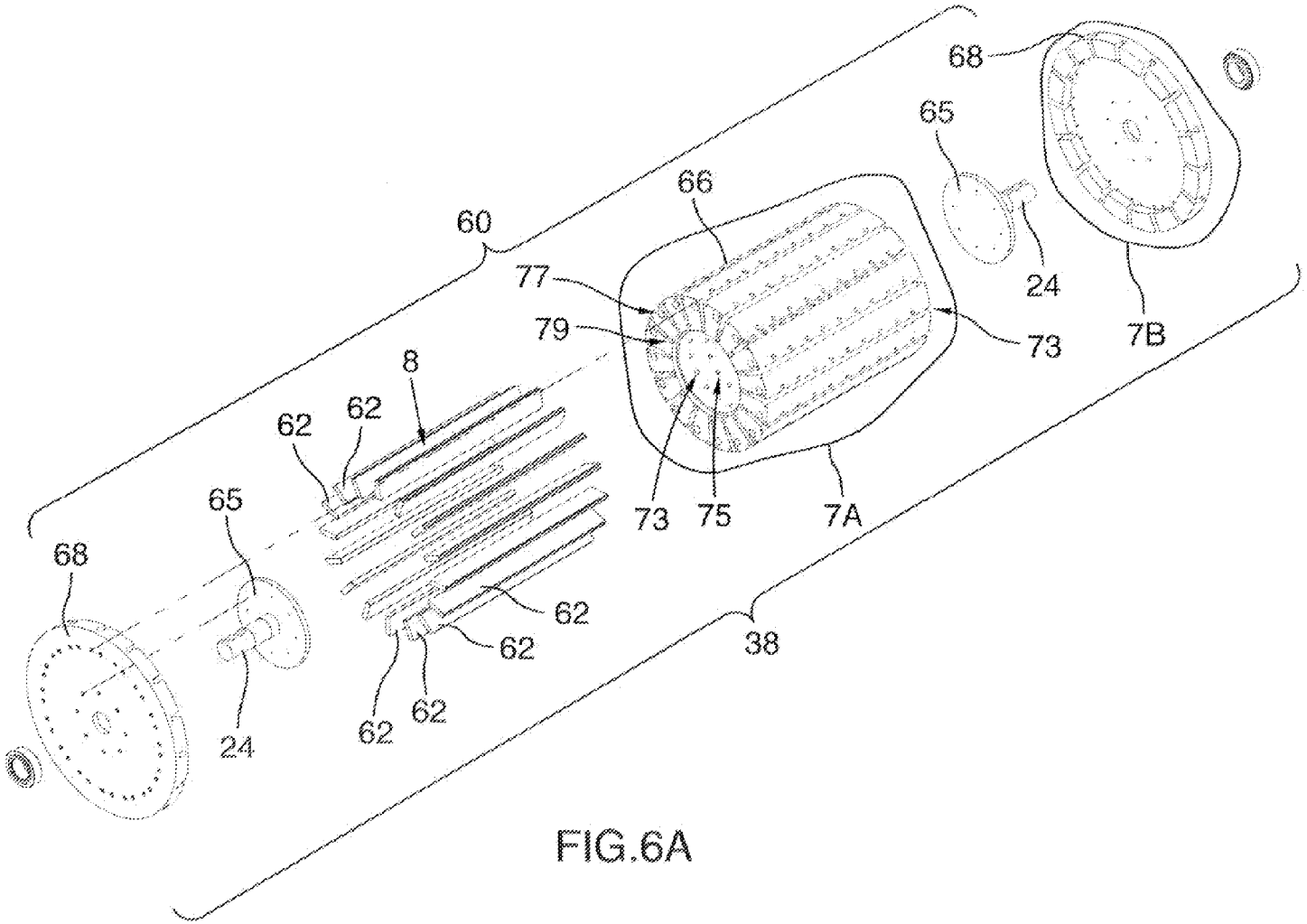
FIG. 6A is an exploded view of the structure of FIG. 6.

With reference to FIG. 6 and FIG. 6A, the rotor assembly 38 will itself been seen to comprise a rotor 60 and a plurality of vanes 62.

Figure 7:
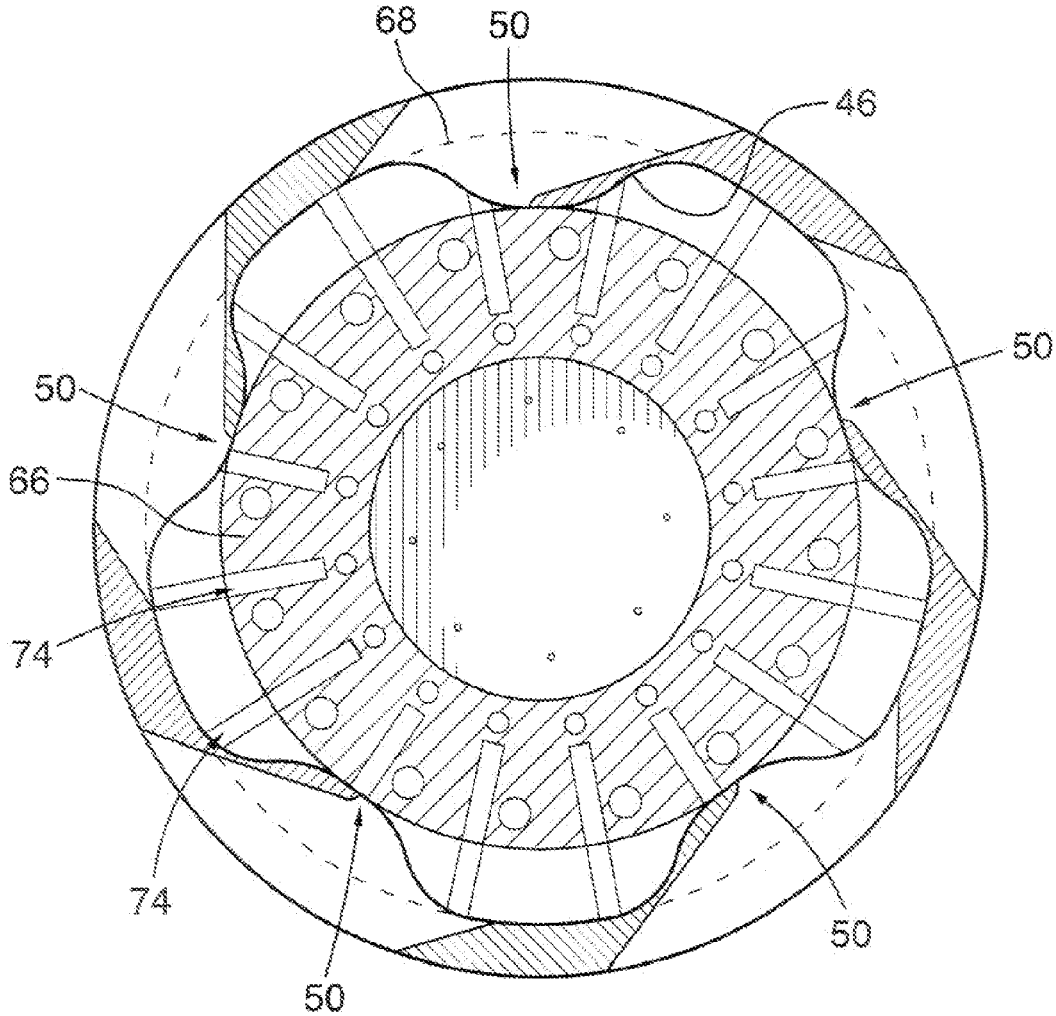
FIG. 7 is a cross sectional view of the structure of FIG. 4 in use with encircled structures 7A, 7B of FIG. 6A.

The rotor 60 includes a rotor body member 66, a pair of end rings 68 and shaft discs 65 from which stubs forming the shaft 24 protrude. Although not shown, it will be understood that threaded shafts extend through communicating bores provided in the main body 66, shaft discs and end rings 60, to hold the rotor 60 together. The main body 66 is fluted, and the end rings 68 are notched, such that the rotor 60 has defined therein a plurality of longitudinally-extending radial slots 74, as best seen in FIG. 7 which is a schematic cross-sectional view showing the dimensional relationships of the notches, flutes and ridges 50. Herein, it will also be seen that the relationship between the outer surface of the main body 66 and the undulating surface 46 of the barrier ring 36 is that of a clearance fit.

Figure 8:
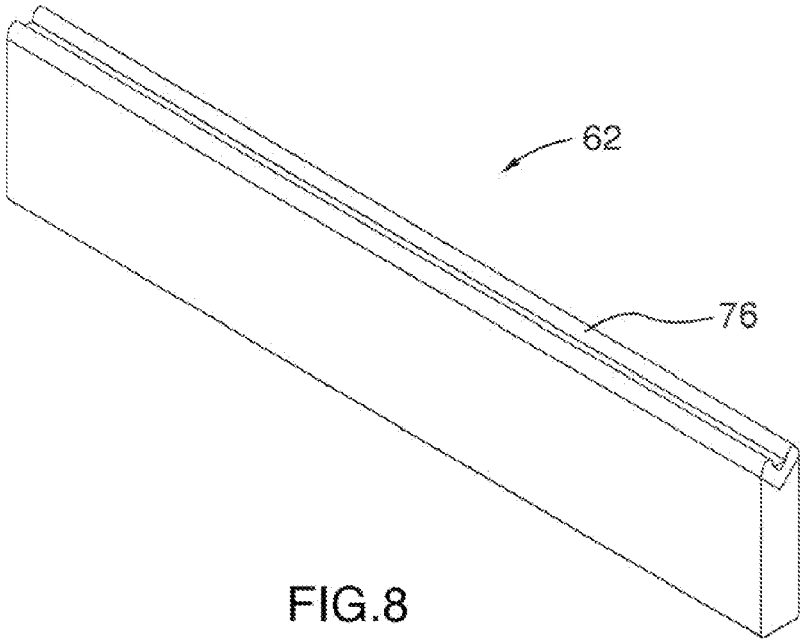
FIG. 8 is an enlarged view of the structure identified with arrow 8 on FIG. 6A.

An exemplary vane is shown in FIG. 8 and will be seen to include a slotted wiper 76 at its tip.

In the device shown, sixteen vanes 62 are provided, and each vane 62 is mounted in the slot 74 provided for it in the manner of a piston in a cylinder. The vanes have substantially neutral buoyancy in the fluid to be pumped, ie they neither float nor sink.

The manner in which the vanes 62 are mounted allows for the vanes 62 to move with the rotor 60 about the longitudinal axis X-X, and also allows for radial extension and retraction thereof relative to the rotor body 66 such that the interior surface 46 of the barrier ring 36 can be swept by the vanes. Notably, as the vanes extend, they do not extend in a cantilevered manner, but are supported throughout such extension by the end rings 68.

The end caps 40 collectively define a sealing structure which seals the gaps between the rotor 60 and barrier ring 36 thereby to permit fluid communication into and out of the rotary device substantially only via the inlets 54 and the outlets 56. As shown, the end caps 40 are secured to one another by threaded rods, and drawn tightly against the barrier ring, to arrest flow around the periphery of the barrier ring, and a pair of gasket rings 53 are provided, which are relatively tightly held against one another in the interstice between the rotor assembly and the end cap, to arrest flow through the hole in the end cap provided for the shaft 24. The end caps 40 also support the bearings 59 which, in turn, support the rotor for rotation, via the shaft 24.

The illustrated, exemplary rotary device also includes a vane actuation arrangement, for causing the vanes 62 to retract and extend as the rotor 60 is rotated, to sweep the interior surface 46 of the barrier ring 36 such that chambers are created which decrease in volume when in communication with the outlets 56 and such that chambers are created which increase in volume when in communication with the inlets 54.

In the exemplary embodiment shown, the vane actuation arrangement includes a plurality of springs 80 and a fluid pressure mechanism.

Figure 9:
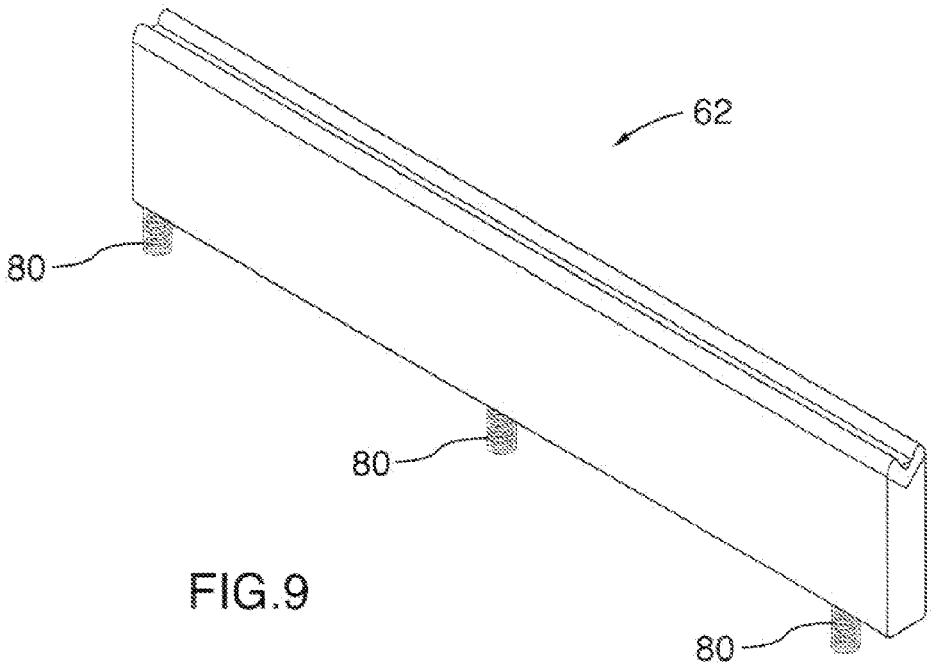
FIG. 9 is a view of the structure of FIG. 8 in use with springs.

The springs 80 are provided for each slot 74, at the base of each vane 62, as shown in FIG. 9. The spring compression varies over its length such that each vane 62 is urged by the spring beneath it against the interior surface 46 of the barrier ring 36 with relatively little force, yet relatively high force is required to bottom out the spring 80, so that the vanes 62 are cushioned.

Figure 10:
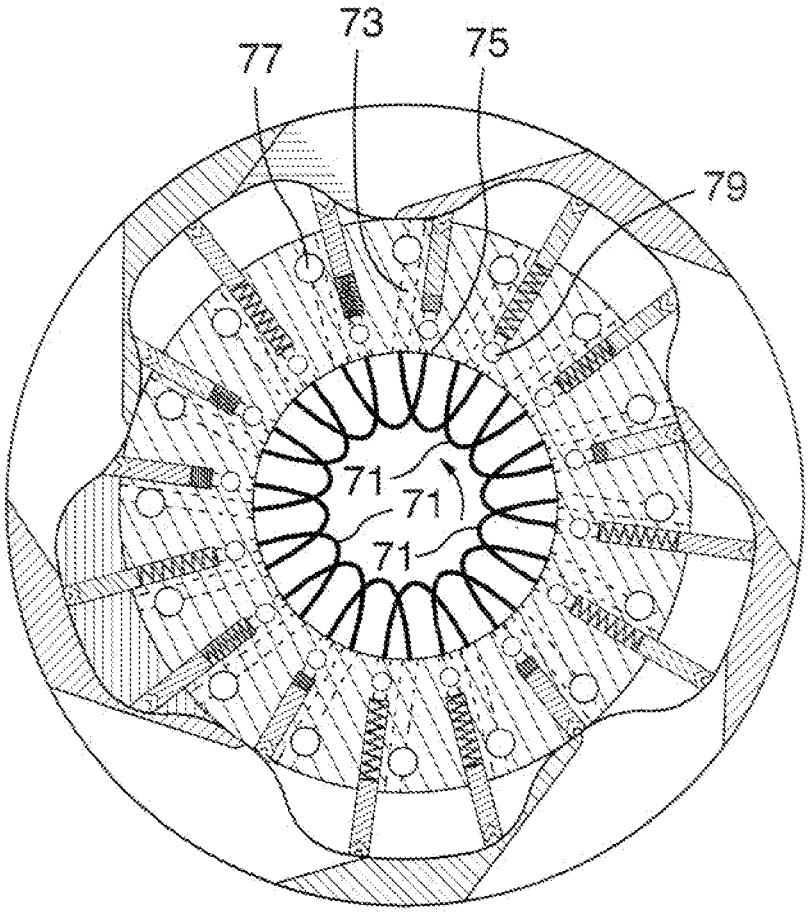
FIG. 10 is a partially schematic view showing the fluid circuit in the structure of FIG. 1.

The fluid pressure mechanism includes a fluid circuit which, in this example, couples the base of each slot to a point in the rotor which, in rotation, immediately precedes the slot immediately preceding the slot from which said fluid path extends. In FIG. 10, it will be seen that the main body member of the rotor has a plurality of bores drilled therein, including bores 73 that extend between the interior and outer annular surfaces, bores 75 that extend from the bases of the slots to the inner annular surface, bores 77 that extend longitudinally to connect bores 73 and bores 79 that extend longitudinally to connect bores 75. These bores are connected by piping, shown schematically by 71, to provide the above-noted fluid connectivity.

Figure 11:
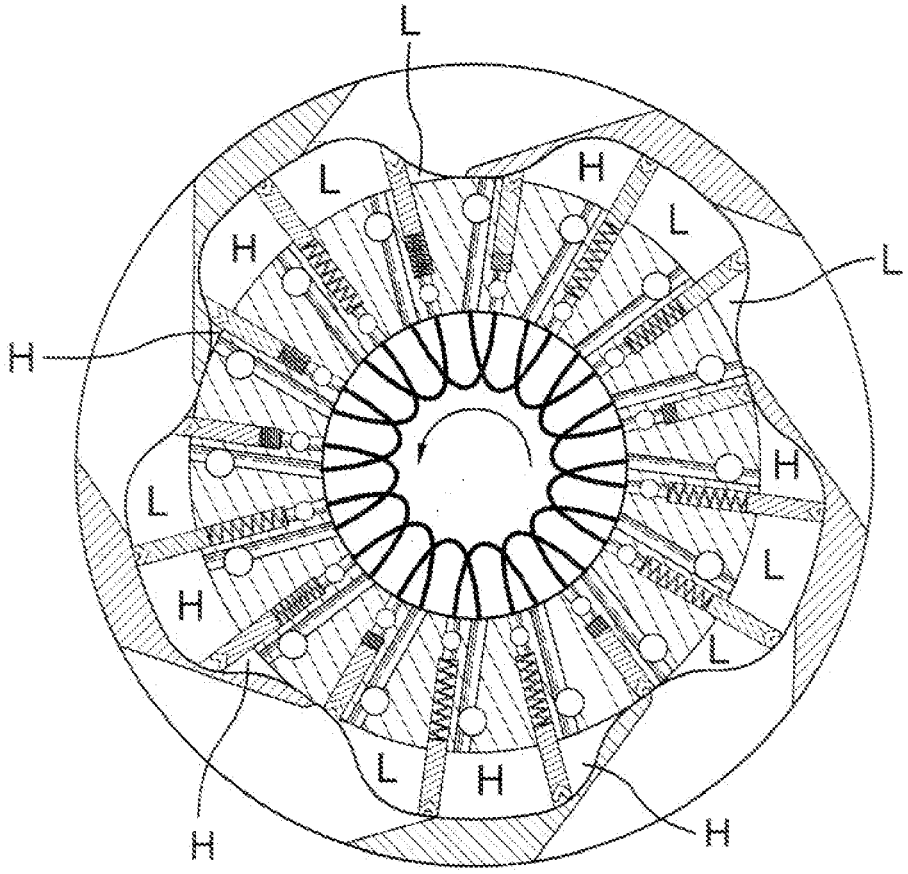
FIG. 11 is a schematic snapshot cross-sectional view of the rotary device of FIG. 1 in use.
Figure 12C:
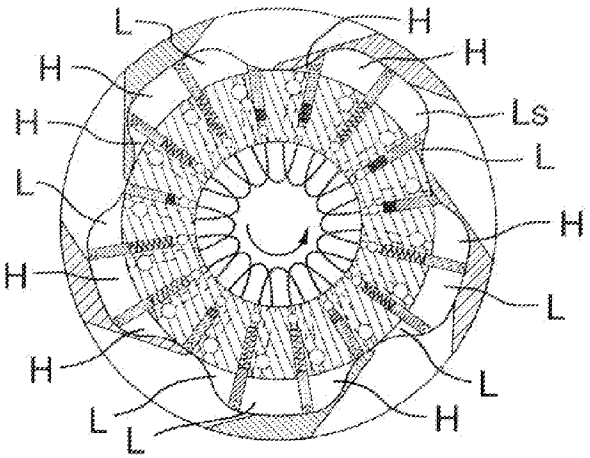
FIG. 12C is a view similar to FIG. 12B, with the rotor slightly advanced.
Figure 12D:
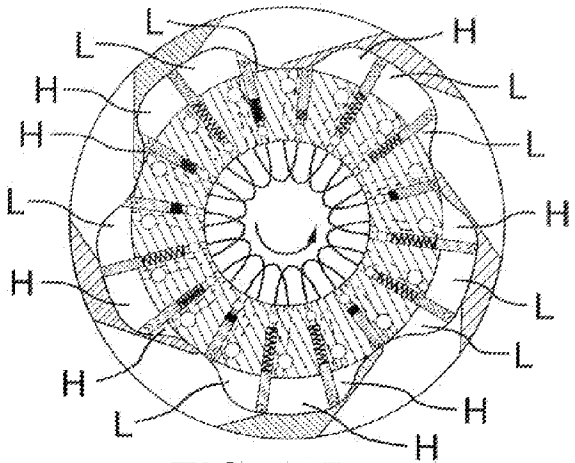
FIG. 12D is a view similar to FIG. 12C, with the rotor slightly advanced.
Figure 12B:
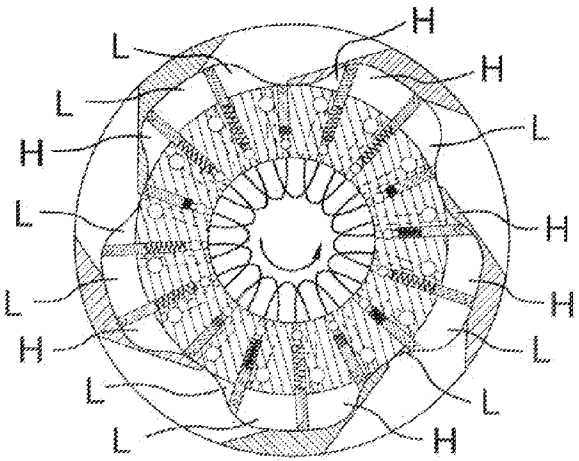
FIG. 12B is a view similar to FIG. 12A, with the rotor slightly advanced.
Figure 12A:
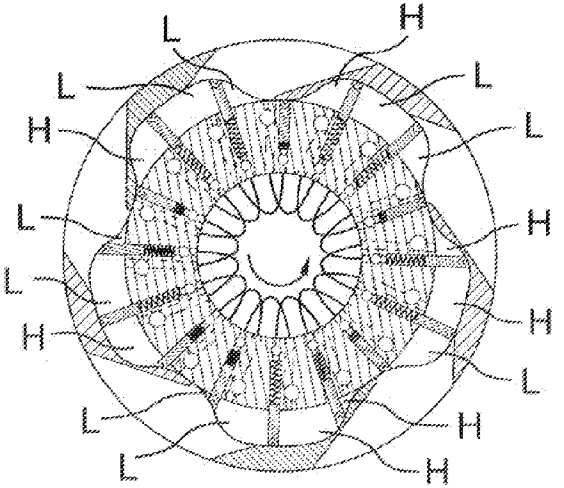
FIG. 12A is a view similar to FIG. 11.

A snapshot of the rotary device in operation is shown schematically in FIG. 11. The arrow indicative of rotation shows the direction of the rotor. Areas of low pressure are indicated by "L", and areas of high pressure are indicated by "H". On inspection, it will be seen that vanes that are nearing a ridge or a ridge crest have low fluid pressure at the base of the slot in which they are mounted and high fluid pressure at their tips, and that high fluid pressure is transferred to the base of vanes once they crest a ridge. The combination of springs, buoyancy and fluid pressure causes the vanes to automatically retract before they reach the ridges, and to "toboggan" down the ridges. Additional examples of such movements are shown in FIGS. 12A-12D.

Figure 13:
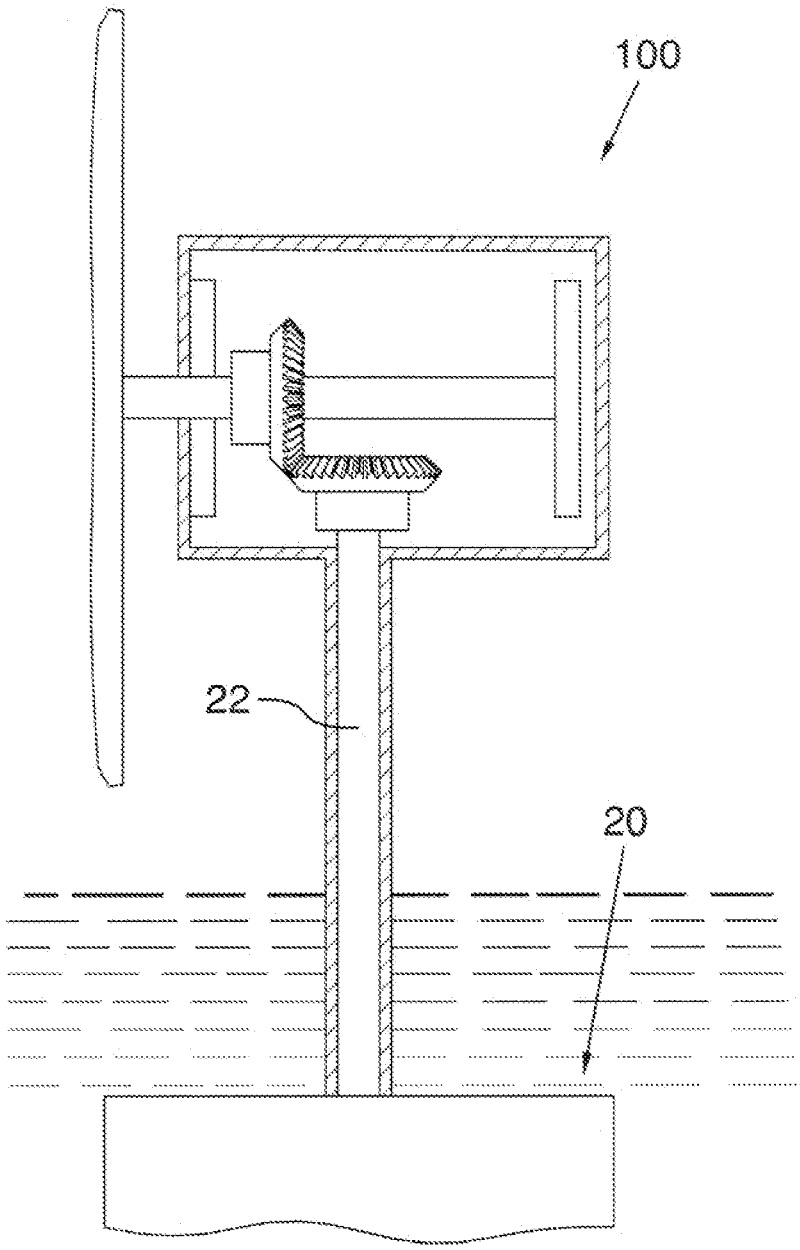
FIG. 13 is a schematic view of a pumping system according to another exemplary embodiment of the invention.

FIG. 13 shows an exemplary application for rotary devices of the present invention. In this application, the rotary device 20 is coupled by a shaft 22 to a windmill 100, at a 1:1 gear ratio. Modern windmills often are intended for blade rotation of less than 20 rpm, and in this application, the pump will similarly be optimized for flow rate at less than 20 rpm.

Whereas a single embodiment of the rotary device is shown in FIGS. 1-12, various changes are contemplated.

Figure 14:
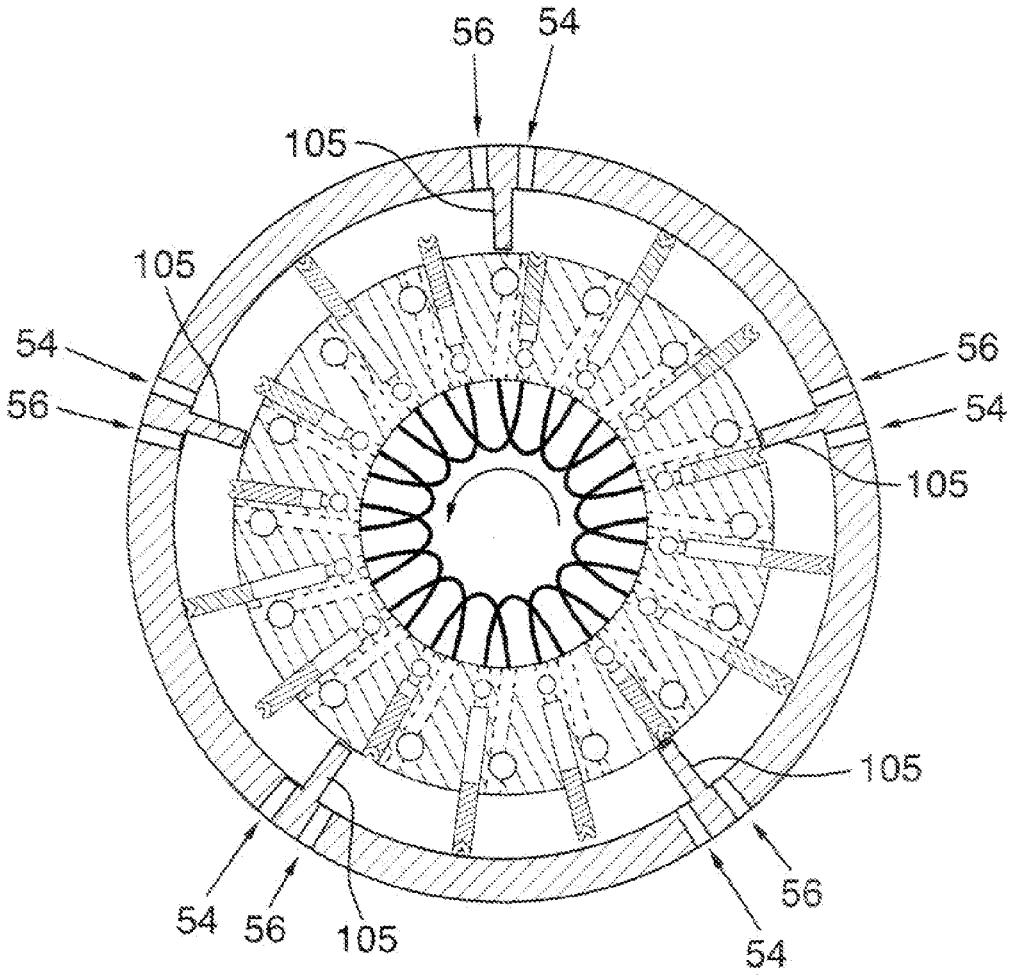
FIG. 14 is a schematic view, similar to FIG. 10, showing another embodiment of the invention.

For example, whereas five ridges are shown, it should be understood that greater or number of ridges may be employed, as desired. For greater clarity in this regard, it should also be "understood" that "ridge" in this description and in the appended claims should be understood to mean a structure for dividing the annular space in which the vanes traverse into subspaces. The "ridge" need not be sinusoidal as shown; it could be, for example, triangular, or even be defined by an upstanding plate 105, as shown in FIG. 14. A five ridge structure as shown is believed to have some advantage over, for example, a four ridge structure, from the standpoint of flow smoothing.

Similarly, whereas a sixteen vane/five ridge apparatus is shown, it is contemplated that the invention can be carried out with greater and lesser numbers of vanes.

Figure 15:
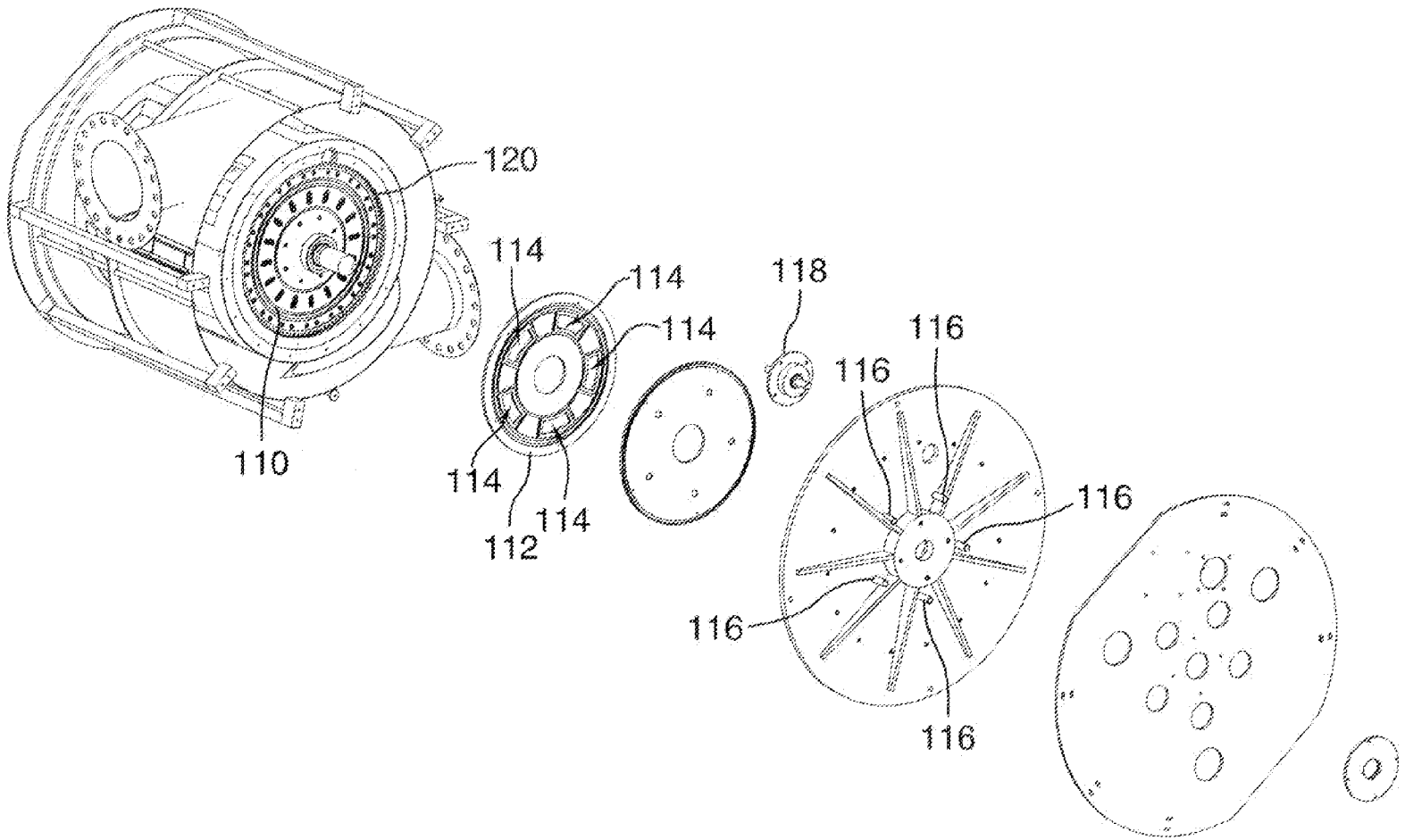
FIG. 15 is a partially exploded perspective view, similar to FIG. 1, showing another embodiment of the invention.

Persons of ordinary skill will readily appreciate that, adjustments to the number of ridges and vanes will require corresponding adjustments to the fluid circuit, so as to ensure that the vanes continue to automatically retract and extend as desired, i.e. if greater numbers of vanes per ridge are employed, the fluid circuit might, for example, couple the base of each slot to a point in the rotor which, in rotation, immediately precedes the slot twice preceding the slot from which said fluid path extends. Further, whereas in the structure illustrated in FIG. 1-FIG. 14, piping interior of the rotor is used to define part of the fluid circuit, and the fluid being pumped is used to actuate the vanes, it should be understood that this is not necessary. For example, FIG. 15 shows a variation, for use with a rotor wherein bores 77, 73 and 75 are not provided and wherein springs are also not provided. In this variation, a pair of discs 110,112 is provided. Disc 110 has provided therein a plurality of apertures, each communicating at all times with a respective bore 79, i.e. disc 110 rotates with the rotor. Disc 112 is stationary, and has defined therein a plurality of holes 114. The holes 114 are spaced-apart from one another and positioned to allow fluid communication between adjacent bores 79 at discrete positions during rotation, i.e. at the positions shown in FIGS. 12A-12D which coincide with positions in rotation wherein movement of the vanes is required (to retract, to crest the ridges and then extend to create the chambers which increase and decrease in volume) and self-actuating (i.e. as a result of localized pressure gradients). In this embodiment, to start the device for pumping, one would initially pressurize the slots with a substantially non-compressible fluid, to extend the vanes.

Further, it should also be understood that persons of ordinary skill might well wish to tune the fluid circuit, i.e. restrict or extend the flow paths, depending, for example, on the pressure head to be generated and the expected RPM of the rotor, so as to avoid hammering of the vanes as they extend and retract. In the context of the embodiment of FIG. 15, for example, bladder tanks (not shown) could be coupled via ports 116 shown in the end plate 40, to provide a cushion.

As well, whereas it is contemplated that the vanes retract under fluid pressure, it should be appreciated that it is not critical that only fluid pressure be employed. The use of fluid pressure retraction generally allows steeper slopes on the ridges, and thus, complete avoidance of fluid pressure retraction would negate certain advantages of the present invention, but it is contemplated that the invention could be employed in combination with conventional cam-style retraction.

As well, routine changes in sizes and shapes of the parts, and their manner of assembly and connection, are also contemplated.

For example, only, FIG. 15 also shows a drive gear 118 and a driven gear 120, which permits the rotor to be turned by a relatively low-torque, high-speed motor.

Yet further, whereas the previous descriptions contemplated the use of the rotary device as a pump, this structure could be used as a motor with suitable modifications to the fluid circuit.

Further, whereas the structure of FIGS. 1-12 shows a unidirectional pump, it is possible to provide a reversible structure, by suitable modification to the rotor. This could take, for example only, the form of additional bores in the rotor body, and switchable fluid circuits.

As well, whereas in FIG. 1, the device is shown with a single fluid inlet and a single fluid outlet, it could be possible to provide greater number of inlets or outlets. As well, the device of FIG. 1 could be embodied as a submersible pump, in which case the housing part 24B could be omitted altogether.

Additionally, whereas no filters or the like are shown in the structure of FIG. 1-12, it will be appreciated that in certain applications, such as pumping of particulate suspensions in liquid, filters could usefully be provided, to avoid particulate infiltration into structures 71,73,75,77 and 79.

Further, whereas a specific vane is shown in FIGS. 8-9, modifications to the vane can be made. Persons of ordinary skill will appreciate that the shape and location of the seal provided by the vane tip will have impacts upon the sealing force. For greater clarity in this regard, it will be appreciated that the base of the vane is acted-upon by the working fluid, i.e. the working fluid is forcing the vane radially outwardly. The tip of the vane will receive force from the fluids in the chambers preceding and following the vane, varying in proportion to the position and shape of the seal, i.e., if the seal is formed towards the leading edge of the vane, the force exerted on the vane to urge same into the slot will come predominantly from the chamber following the vane, and only slightly from the chamber preceding the vane. This, of course, has consequences, in that the pressures of the chambers preceding and following the vane can vary in operation, and persons of ordinary skill can and will modify the shape of the vane tip for any given pumping application, so as to ensure that an appropriate amount of sealing force is exerted, to maximize pumping efficiency without adding unduly to wear or energy requirements.

Accordingly the invention should be understood as limited only by the accompanying claims, purposively construed.

What is claimed is:

1. A rotary device comprising:

a barrier ring having: a central longitudinal axis; a tubular interior surface through which the longitudinal axis extends centrally, in spaced relation, the interior surface including one or more portions which each define a longitudinally extending, inwardly-projecting ridge; and defined therethrough, on opposite circumferential sides of each of said one or more ridges, a first port and a second port;

a rotor mounted for rotation in the barrier ring about the longitudinal axis, the rotor including a rotor body;

a plurality of vanes mounted to the rotor body for rotation with the rotor body about the longitudinal axis and for radial extension and retraction relative to the rotor body such that at least portions of the interior surface of the barrier ring can be swept by the vanes;

a sealing structure providing a seal between the rotor and the barrier ring to permit fluid communication into and out of the rotary device substantially only via the first and second ports; and an arrangement for causing the vanes to retract and extend as the rotor body rotates such that chambers are created which decrease in volume when in communication with the first ports and such that chambers are created which increase in volume when in communication with the second ports, the arrangement including a fluid pressure mechanism for causing the vanes to retract.

2. A rotary device according to claim 1, wherein the rotor further comprises a pair of axially spaced supports which support the axially-spaced edges of the vanes when extended from the rotor body.

3. A rotary device according to claim 2, wherein the fluid pressure mechanism is for causing retraction and, at least in part, extension of the vanes.

4. A rotary device according to claim 3, wherein:

the rotor defines a slot for each vane, each vane being mounted in the slot provided for it in the manner of a piston in a cylinder; and the fluid pressure mechanism comprises a fluid circuit which couples the base of each slot to a point in the rotor which, in rotation, immediately precedes the slot immediately preceding the slot from which said fluid path extends.

5. A rotary device according to claim 3, wherein:

the rotor defines a slot for each vane, each vane being mounted in the slot provided for it in the manner of a piston in a cylinder; and the fluid pressure mechanism comprises a fluid circuit which, in rotation, selectively couples the base of each slot approaching a ridge to the base of the slot immediately preceding said each slot.

6. A rotary device according to claim 3, wherein:

the rotor defines a slot for each vane, each vane being mounted in the slot provided for it in the manner of a piston in a cylinder;

the fluid pressure mechanism provides for fluid communication between slots occupied by vanes which in use need to retract to breach the ridges and slots occupied by vanes which in use need to extend to sweep the barrier ring; and in use, the pressure of the fluid passing between the first and second ports provides the motive force for the extension and retraction of the vanes.

7. A rotary device according to claim 3, wherein the fluid pressure mechanism causes the vanes to retract as they approach the ridges and to extend after they pass the ridges.

8. A rotary device according to claim 4, further comprising, in each slot, a spring biasing the vane mounted within said each slot for extension.

9. A rotary device according to claim 8, wherein the spring compression varies over its length, such that, in use, relatively high force is required to bottom out the spring; and as the vane reaches full extension, the spring provides relatively low force to the vane.

10. A rotary device according to claim 1, wherein the one or more portions comprises a plurality of portions, each defining a longitudinally extending, inwardly-projecting ridge.

11. A rotary device according to claim 3, wherein the first ports are outlets and the second ports are inlets.

12. A pump for a fluid, said pump comprising:

a rotary device according to claim 11; and a shaft coupled to the rotor body for receiving power and converting received power into rotation of the rotor such that, if the inlets are placed in communication with a supply of said fluid at a relatively low pressure, the outlets create a supply of fluid at a relatively higher pressure.

13. A pump according to claim 12, wherein the vanes have neutral buoyancy in said fluid.

14. A fluid pumping system comprising:

a windmill which, in use, rotates at less than 20 rpm; and a pump according to claim 13 which rotates in use at less than 20 rpm.

15. A fluid pumping system according to claim 14, wherein the windmill, in use, rotates at less than 20 rpm and wherein the pump rotates, in use at less than 20 rpm.

* * * * *